US008042599B2

(12) United States Patent
Seserko

(10) Patent No.: US 8,042,599 B2
(45) Date of Patent: Oct. 25, 2011

(54) METHOD FOR PRODUCING A MULTITUDE OF COMPONENTS MADE OF, IN PARTICULAR, TITANIUM ALUMINIDE, AND DEVICE FOR CARRYING OUT THIS METHOD

(75) Inventor: Pavel Seserko, Karlstein (DE)

(73) Assignee: ALD Vacuum Technologies GmbH, Hanau (DE)

( * ) Notice: Subject to any disclaimer, the term of this patent is extended or adjusted under 35 U.S.C. 154(b) by 237 days.

(21) Appl. No.: 11/887,983

(22) PCT Filed: Apr. 6, 2006

(86) PCT No.: PCT/DE2006/000616

§ 371 (c)(1),
(2), (4) Date: Dec. 18, 2007

(87) PCT Pub. No.: WO2006/105780

PCT Pub. Date: Oct. 12, 2006

(65) Prior Publication Data

US 2009/0050284 A1 Feb. 26, 2009

(30) Foreign Application Priority Data

Apr. 7, 2005 (DE) ..... 10 2005 015 862

(51) Int. Cl.
*B22D 27/15* (2006.01)

(52) U.S. Cl. ..... 164/34; 164/44; 164/516; 164/517; 164/518; 164/519

(58) Field of Classification Search ..... 164/34, 164/34.44, 516–519
See application file for complete search history.

(56) References Cited

U.S. PATENT DOCUMENTS

| | | | | |
|---|---|---|---|---|
| 5,287,910 | A * | 2/1994 | Colvin et al. | 164/63 |
| 5,311,655 | A | 5/1994 | Jager et al. | |
| 5,819,837 | A * | 10/1998 | Hugo et al. | 164/61 |
| 6,386,265 | B1 | 5/2002 | Usui | |
| 2007/0267165 | A1 * | 11/2007 | Monteiro et al. | 164/65 |

FOREIGN PATENT DOCUMENTS

| | | | |
|---|---|---|---|
| DE | 26 35 182 | A1 | 7/1977 |
| DE | 26 51 842 | A1 | 5/1978 |
| DE | 29 21 192 | A1 | 12/1980 |
| DE | 38 15 828 | C2 | 11/1988 |
| DE | 196 07 805 | C1 | 7/1997 |
| DE | 197 16 440 | C1 | 8/1998 |
| DE | 198 08 552 | A1 | 8/1999 |
| DE | 199 59 960 | A1 | 6/2000 |
| DE | 100 57 308 | A1 | 5/2002 |
| DE | 101 20 493 | C1 | 7/2002 |
| DE | 693 31 092 | T2 | 7/2002 |

(Continued)

*Primary Examiner* — Jessica L Ward
*Assistant Examiner* — Erin Saad
(74) *Attorney, Agent, or Firm* — Fulbright & Jaworski L.L.P.

(57) ABSTRACT

The invention relates to a method and to a device for sing out this method, during which the shell molds (3) are filled with a melt (11) in a clocked manner, the respectively required amount of melt being currently provided at the same time. The casting process ensues by marrying the crucible (6), which is filled with a melt (11), with a shell mold (3) so that the crucible (6) and shell mold (3) form a common cavity (10), and this arrangement is subsequently tilted 180°, so that the melt (11) falls into the shell mold (3).

6 Claims, 2 Drawing Sheets

FOREIGN PATENT DOCUMENTS

Figure 1:
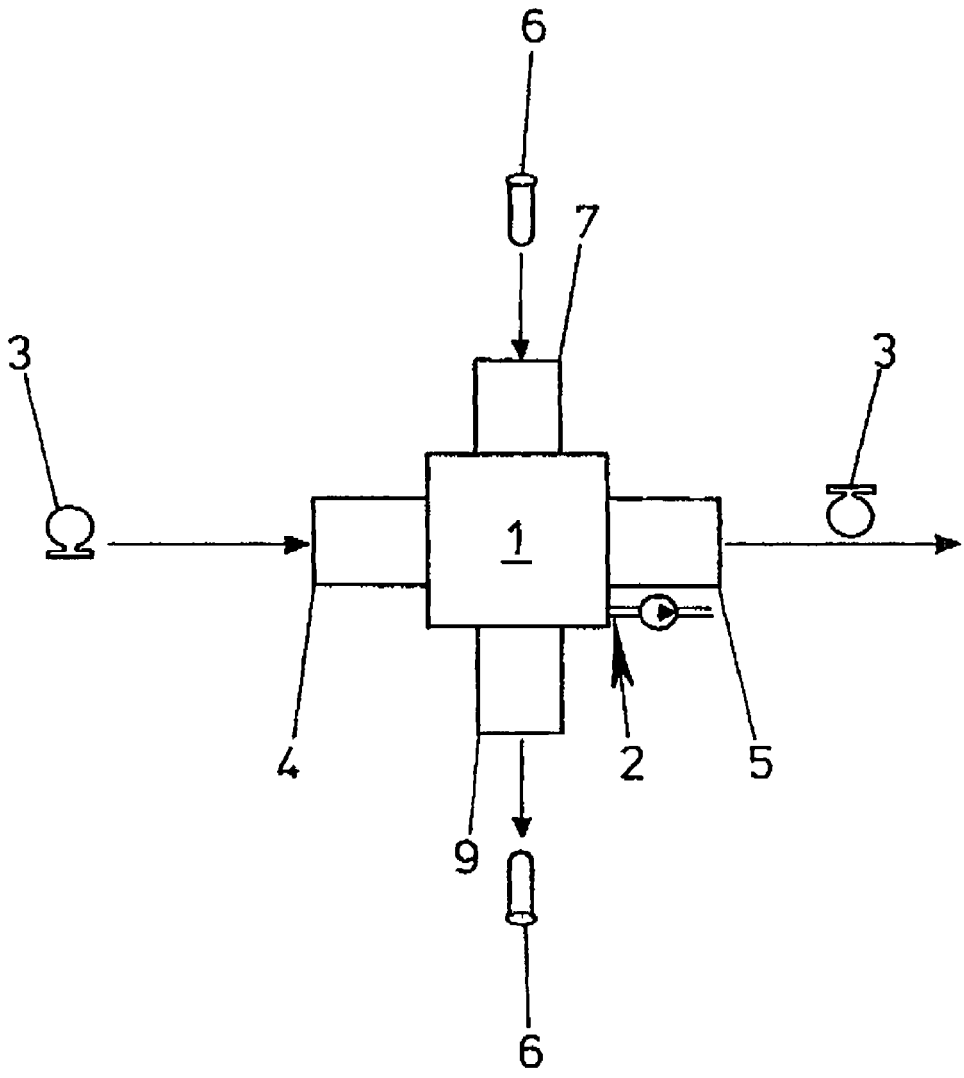

| | | | |
|---|---|---|---|
| EP | 0 530 968 | A1 | 3/1993 |
| EP | 0 568 951 | A2 | 11/1993 |
| GB | 633 946 | A | 12/1949 |
| GB | 842158 | | 7/1960 |
| JP | 04033768 | A | 2/1992 |
| JP | 05154642 | A | 6/1993 |
| JP | 05261516 | A | 10/1993 |
| JP | 2003266166 | A1 | 9/2003 |
| WO | WO 2005025778 | A1 * | 3/2005 |

* cited by examiner

METHOD FOR PRODUCING A MULTITUDE OF COMPONENTS MADE OF, IN PARTICULAR, TITANIUM ALUMINIDE, AND DEVICE FOR CARRYING OUT THIS METHOD

The invention relates, on the one hand, to a method for the production of a multiplicity of structural parts comprised, in particular, of titanium aluminide, in which a melt of the material of which the structural parts are to be comprised is introduced into shell molds, which are reproductively negative with respect to the structural parts, and these, after the solidification of the melt, are removed. Typical structural parts, which are produced according to such method, are, for example, turbine buckets or wheels for turbochargers.

The procedure, in principle, is as follows. As large a number of shell molds as possible is combined into a tree, in that, first, a positive mold of wax is produced, which reproduces the individual structural parts as well as also the infeed channels. The negative mold serves for generating a multishell mold of ceramic, which includes a central inlet connecting piece and with which a number of structural parts, corresponding to the number of individual shell molds in the multishell mold, can be generated in one casting. To fill these multishell molds a relatively large quantity of material is melted and introduced into the multishell mold.

This procedure is highly time-consuming and personnel-intensive, since the negative mold must be created manually. Furthermore, a large quantity of ceramic is required for the production of the multishell mold, since such not only needs to reproduce the individual structural parts but also the infeeds. In addition, more casting material is required for filling the multishell mold than is needed for the structural parts themselves, since a portion of the casting material also fills the infeeds. This fraction is lost, which leads to a corresponding increase in the expense of the structural parts, especially in the case of expensive materials such as TiAl.

Such an approach is furthermore not suitable for all materials since certain materials already partially solidify on their way through the channels to the individual shell molds. This applies in particular to so-called intermetallic compounds, such as, for example, titanium aluminide, this material, however, being preferred precisely for said structural parts, since it is highly heat-resistant, stable and yet especially light [weight].

The invention therefore addresses the problem of providing a casting method, which is above all suitable for the production of structural parts of intermetallic compounds and which, moreover, makes possible the cost-effective mass production of structural parts independently of the particular material utilized.

For the solution of the problem the invention provides that the shell molds are supplied individually to a casting apparatus at a predetermined work cycle and that the melts are in each instance generated at the required time and concurrently at the same work cycle from a size corresponding to an ingot in that quantity which is required for filling a shell mold.

The invention consequently becomes distinct from the concept of simultaneously casting a multiplicity of structural parts and moves to a single piece line concept, in which the shell molds are filled out at a clocked rate, wherein the particular melt quantity is made available at such time.

In this concept the melt can reach the shell mold on a short path, such that partial solidification cannot even occur on the path to the shell mold. The reject rates are thereby considerably decreased.

Since the structural parts are produced according to the invention at a clocked rate, quality controls on the individual structural parts can also be performed at a clocked rate and can optionally also be automated, such that the process overall can be better managed and controlled.

Since the shell molds must only reproduce the structural part and not the infeed channels to the shell mold, the consumption of ceramic or of the casting materials is markedly reduced, such that here also a reduction of the cost of the piece number can be expected.

The recommended clock time of the facility should be approximately 1 minute or less per structural part. According to the invention this is possible since:

1. the structural parts are cast and worked individually,
2. the quantity of material required in each instance corresponds to the volume of the structural part and, consequently, short melting times are realized,
3. a facility for carrying out the method can be built compactly and, consequently, the melt reaches the shell mold on a short path,
4. pouring and solidification occur rapidly, such that only minor reactions of the casting material (in particular TiAl) with the ceramic of the shell mold occur, and
5. the chambers of the facility have small volumes and therewith
6. with the pouring under vacuum short evacuation times are realized.

Since, as explained, the particular quantity of melt is provided concurrently at the required time, the invention preferably provides that the crucibles are only of the appropriate size. Such crucibles, which are comprised of a low quantity of crucible material, can be rapidly heated, such that here also no unnecessary energy waste occurs. The crucibles are preferably used only once, such that possibly occurring contaminations are not transferred to the next melt.

Especially in the case of intermetallic compounds it is critical that the pouring process is carried out relatively rapidly. The invention therefore provides that the melt is not poured in a jet, but rather is plunged into the shell mold. For this purpose the shell mold is placed upside down onto the margin of the crucible filled with the melt, such that the crucible and shell mold enclose a common cavity, and that subsequently the arrangement of crucible and shell mold is rotated about a horizontal axis by more than 90°, preferably by 180°.

If the rotational movement is carried out rapidly, the molten material plunges or falls into the shell mold, wherein the melt by its own weight and the absorbed free-fall energy reaches the shell mold with active force and neatly fills even the smallest outformings in the shell mold.

Since for the plunging only a negligibly short time is required, solidification only sets in after the material is completely within the shell mold.

The shell molds can be implemented as lost shell molds, which are supplied at a clocked rate to the casting apparatus and removed again after they have been filled. Such shell molds, as stated above, are preferably comprised of a ceramic.

However, it is also possible to consider implementing the shell molds as two-part permanent molds. This lends itself especially when the solidification occurs relatively rapidly, quasi at the predetermined clock of the casting apparatus. In this case, after the solidification, the permanent mold only needs to be opened such that the solidified structural part falls out. Should the solidification take more time than a possible work cycle, two or three permanent molds can also be used alternately.

The invention further relates to a device for carrying out the previously described method. The device is characterized thereby that it is comprised of a casting chamber, in which a crucible with molten material and a shell mold are made available at a clocked rate, which, furthermore, includes a casting means in order to join crucible and shell mold such, that the shell mold after its inversion rests on the crucible margin, and which is cable of tilting the crucible together with the shell mold about a horizontal axis by more than 90°, preferably by 180°.

Consequently, with the aid of the casting means crucible and shell mold are "married" to one another in the casting chamber, subsequently inverted, such that the melt is transferred to the shell mold, and subsequently separated again. It is critical that the process is repeated at a clocked rate, such that a multiplicity of structural parts can be generated in a process which is constant and identical. Since the process itself is very simple and functions in relatively simple manner, breakdowns in the sequence are not to be expected.

In order for the casting material to be kept in the molten state for only a relatively short time, the invention provides that the casting chamber is directly preceded by a melting chamber, into which a crucible, provided in each instance with an ingot, is introduced at a clocked rate and exposed to a melting energy which melts the ingot. As soon as the material is in molten form, the crucible is transferred from the melting chamber into the casting chamber and can be joined with the shell mold in the previously described manner. To melt the ingot, an induction heater is preferably provided, which is provided in the melting chamber and into which the crucibles are immersed at a clocked rate.

As already stated, the shell molds can be lost molds. The casting chamber in this case includes an infeed means by means of which the shell molds are supplied at a clocked rate. In the casting chamber, alternatively, one or more two-part permanent shell molds can also be provided.

To prevent contamination of the melt, the casting chamber can be laid out as a vacuum chamber, which in this case is provided with appropriate locks.

To avoid solidification of the material before the inversion, the casting means can be provided with a heating means, with which the crucible and/or shell molds are heated until the casting.

Figure 2:
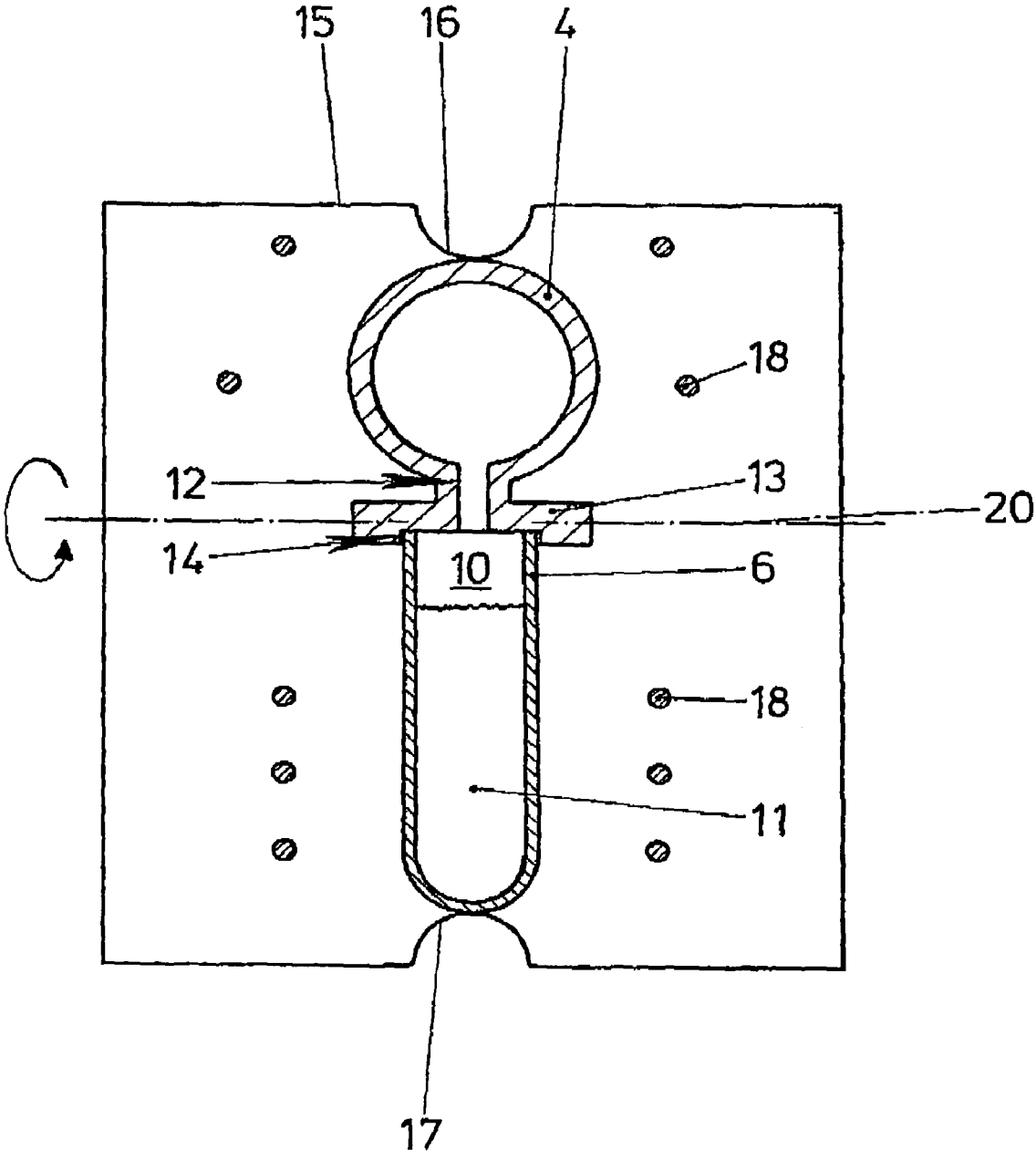

In the following, the invention will be explained in further detail with reference to an embodiment example. In the figures depict:

FIG. 1 a fundamental depiction of a facility with which the method according to the invention can be carried out, FIG. 2 the joining of the crucible with a shell mold in a holder.

Firstly, reference is made to FIG. 1.

The center of the facility is formed by a casting chamber 1, which optionally includes a vacuum connection 2 such that the pouring takes place under vacuum. Through this casting chamber 1 pass shell molds 3 in one direction at a clocked rate, which molds are supplied on the one side to the casting chamber 1 via a lock 4, and, on the other side, are fed out via a further lock 5. Transversely thereto crucibles 6 are guided through the casting chamber 1, wherein the crucibles 6 filled with an ingot are supplied to the casting chamber 1 via a third lock 7, which simultaneously serves as melting chamber, and via a fourth lock 9 are removed from the casting chamber 1 after they have been emptied. The first lock 4 for shell molds can also be implemented as a heating chamber in order to preheat the shell molds.

Melting the material in the melting chamber 7 preferably takes place by means of an induction heater, which is not further shown here, which, however, is part of prior art and is generally known to a person of skill in the art. Shell molds 3 and crucibles 6 are transported on transport sections, each of which work at a clocked rate.

In the casting chamber 1 one crucible 6 and one shell mold 3 each are brought together in the manner shown in FIG. 2. For this purpose, robots or manipulation apparatus, not further shown here, are available, which set the shell mold 3 after inversion onto a crucible 6, such that a common cavity 10 is formed. In the crucible 6 is located the melt 11, which is precisely sufficient to fill the shell mold 3. The shell mold 3 is herein precisely of such size as to reproduce the structural part. An infeed channel 12 is kept as short as possible.

On the shell mold 3 is only provided an offset 13 with a step 14, which just extends beyond the margin of the crucible 6. If necessary, clamps can be provided in order to hold crucible 6 and shell mold 3 firmly together. Suitable for this purpose is, for example, a frame 15, which is indicated schematically in FIG. 2 and which includes projections 16, 17 which, on the one side, are stayed on the head of the shell mold 3 or on the bottom of the crucible 6.

The frame 15 is optionally provided with heating coils 18 which are disposed around the crucible 6 as well as also around the shell mold 3 and which are intended to hold the arrangement at a suitable casting temperature.

To fill the shell mold 3, the frame 15 is rotated about a horizontal axis 20, which, for example, extends through the connection between shell mold 3 and crucible 6. After a rapid rotation about 180°, the shell mold 3 is disposed beneath the crucible 6, such that the melt 11 plunges into the shell mold 3.

The manipulation means subsequently separates the emptied crucible 6 and the filled shell mold 3 and transports these through the second or fourth lock 5, 9 out of the casting chamber 1, such that in the next cycle a new shell mold 3 and a new crucible 6 can be introduced into the casting chamber 1 for filling out the shell mold.

Alternatively to the use of a lost shell mold, a permanent shell mold can also be utilized, which is preferably of two parts. In this case at the bottom of the casting chamber 1 is located an opening with a lock, through which opening the solidified structural part can fall after the shell mold 3 is opened.

LIST OF REFERENCE NUMBERS

1 Casting chamber
2 Vacuum closure
3 Shell mold
4 Infeed lock
5 Lock
6 Crucible
7 Melting chamber
9 Lock
10 Cavity
11 Melt
12 Infeed channel
13 Offset
14 Step
15 Frame
16, 17 Projection
18 Heating coil
20 Axis

The invention claimed is:

1. A method comprising producing a multiplicity of structural parts comprising providing a melt of titanium aluminide, introducing the melt into shell molds wherein each of the shell molds is reproductively negative with respect to one single structural part, removing the shell molds after the solidification of the melt, wherein the melt is introduced into the shell mold by placing an individual shell mold upside down onto the margin of a crucible filled with melt to form an arrangement, such that the crucible and the shell mold enclose a common cavity, and subsequently rotating the arrangement of crucible and shell mold about a horizontal axis by more than 90°, providing a casting chamber in which crucibles with molten material and shell molds for forming one single structural part of the multiplicity of structural parts are made individually available at a clocked rate, providing a casting apparatus in the casting chamber, wherein the casting apparatus joins one of said crucibles and one of said shell molds for forming one single structural part such that said shell mold after inversion rests on the margin of the crucible, and which tilts said shell mold joined with said crucible about a horizontal axis by more than 90°, wherein the shell molds are individually supplied to the casting apparatus at a predetermined work cycle and wherein the melt needed in each instance of the work cycle is provided in a quantity required for filling a single shell mold, wherein the melt is currently generated in the same work cycle from an ingot of a size corresponding to the amount of melt needed for filling a single shell mold, wherein the casting chamber is preceded by a melting chamber, into which the crucibles each filled with an ingot are introduced at a clocked rate and are exposed to an energy source which melts the ingot in the crucible.

2. A method as claimed in claim 1, wherein the arrangement is rotated about a horizontal axis by 180°.

3. A method as claimed in claim 1, wherein the shell mold is a lost shell mold.

4. A method as claimed in claim 1, wherein the shell mold comprises a ceramic.

5. A method as claimed in claim 1, wherein the shell mold is a two-part permanent mold.

6. A method as claimed in claim 1, wherein the shell mold comprises a ceramic and wherein the shell mold is a two-part permanent mold.

* * * * *